US012527993B2

(12) United States Patent
Paul et al.

(10) Patent No.: US 12,527,993 B2
(45) Date of Patent: Jan. 20, 2026

(54) LAWN BOWL

(71) Applicant: COMFITPRO (PTY) LTD, Sydney (AU)

(72) Inventors: Robin Paul, Denham Court (AU); Gregory Williams, Milton (AU); Walter Jacobs, Vaucluse (AU)

(73) Assignee: ComfitPro (PTY) LTD, Sydney (AU)

( * ) Notice: Subject to any disclaimer, the term of this patent is extended or adjusted under 35 U.S.C. 154(b) by 244 days.

(21) Appl. No.: 17/976,081

(22) Filed: Oct. 28, 2022

(65) Prior Publication Data

US 2024/0139586 A1 May 2, 2024

(51) Int. Cl.
*A63B 37/00* (2006.01)
*A63B 45/00* (2006.01)

(52) U.S. Cl.
CPC ..... *A63B 37/00* (2013.01); *A63B 45/00* (2013.01); *A63B 2243/0058* (2013.01)

(58) Field of Classification Search
CPC ..... A63B 37/00; A63B 2243/0058; A63B 43/002
See application file for complete search history.

(56) References Cited

U.S. PATENT DOCUMENTS 6,634,970 B2 * 10/2003 Jiminez ..... A63B 41/08 473/597
7,048,656 B2 * 5/2006 Litchfield ..... B29C 33/14 473/600
7,263,952 B1 * 9/2007 Tsengas ..... A01K 15/026 119/711
D583,427 S * 12/2008 Saghir ..... D21/713
7,470,203 B1 * 12/2008 Stillinger ..... A63B 37/12 473/574
D690,377 S * 9/2013 Cranke ..... D21/713
8,708,843 B1 * 4/2014 Sekac ..... A63B 43/002 473/422
D727,445 S * 4/2015 Viramontez ..... D21/781
9,675,847 B2 * 6/2017 Jahnigen ..... A63B 37/02
D849,161 S * 5/2019 Zawitz ..... D21/713
D855,134 S * 7/2019 Wang ..... D21/713
10,576,334 B2 * 3/2020 Wang ..... A63B 45/00
11,110,324 B2 * 9/2021 Nürnberg ..... A63B 41/08
11,904,213 B2 * 2/2024 Morris ..... A63B 41/02
(Continued)

FOREIGN PATENT DOCUMENTS

FR 2032225 A5 * 11/1970
GB 191416364 A * 5/1915
(Continued)

OTHER PUBLICATIONS

Google definition for "solid", <https://www.google.com/search?q=solid+definition&sca_esv=07ed4e611c1941a0&source=hp&ei=WQXKZ4nQMr2f5NoPkeuh2QI&iflsig=ACkRmUkAAAAAZ8oTaZzC_95m3oz8aPsHzj5wQLOY8yQa&ved=0ahUKEwjJ4JfBpfaLAxW9D1kFHZF1KCsQ4dUDCBA&uact=5&oq=solid+definition&gs_lp=Egdnd3Mtd216lhBzb2xp>, retrieved on Mar. 6, 2025. (Year: 2025).*

*Primary Examiner* — Steven B Wong
(74) *Attorney, Agent, or Firm* — Foster Swift Collins & Smith PC; Mikhail Murshak

(57) ABSTRACT

The invention provides a bowl. The bowl is provided with at least one grip ring, which grip ring is in the form of a first groove formed into the surface of the bowl and a second groove formed into the surface of the first groove, and a resiliently deformable or elastic band which fits into the second groove such the surface of the band is flush with or slightly proud of the surface of the first groove.

9 Claims, 2 Drawing Sheets

(56) References Cited

U.S. PATENT DOCUMENTS

Figure 1:
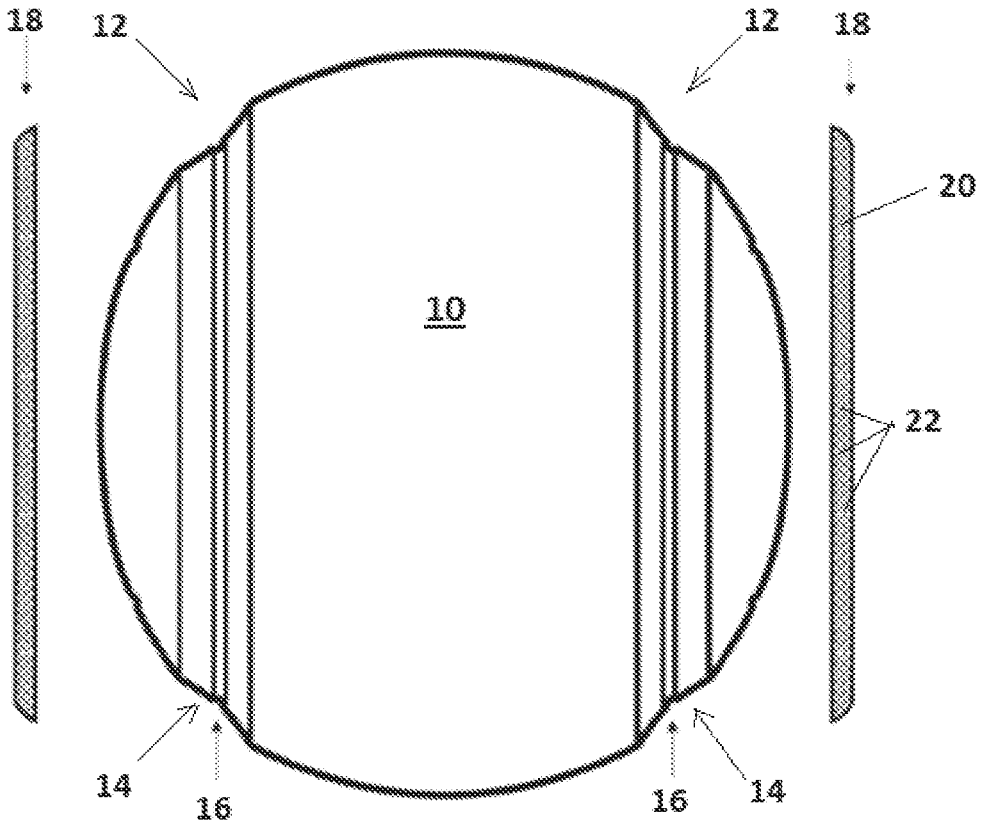

| | | | | |
|---|---|---|---|---|
| 2002/0025866 | A1* | 2/2002 | Thomas | A63B 37/14 473/598 |
| 2004/0121865 | A1* | 6/2004 | Lee | A63B 41/08 473/597 |
| 2015/0328519 | A1* | 11/2015 | Lake | A63B 47/00 473/447 |
| 2018/0043217 | A1* | 2/2018 | Kim | A63B 43/002 |
| 2021/0331040 | A1* | 10/2021 | Lin | A63B 45/00 |

FOREIGN PATENT DOCUMENTS

| | | | | | |
|---|---|---|---|---|---|
| GB | 279624 | A | * | 11/1927 | |
| GB | 2297694 | A | * | 8/1996 | A63B 37/10 |
| GB | 2494966 | A | * | 3/2013 | A63B 37/00 |
| KR | 20120119486 | A | * | 10/2012 | |
| NZ | 602210 | A | * | 12/2013 | A63B 37/00 |
| WO | WO-2004002583 | A1 | * | 1/2004 | A63B 37/10 |
| WO | WO-2020026175 | A1 | * | 2/2020 | |

* cited by examiner

LAWN BOWL

TECHNICAL FIELD OF THE INVENTION

This invention relates to lawn bowls

BACKGROUND TO THE INVENTION

The sport of lawn bowling is popular around the world. A lawn bowl is a ball of solid material which is designed to be bowled along a vector. The vector is transverse to the axis of the ball, which axis is normally indicated on the ball with a spot or small ring. The centre of gravity is offset to the axis, called a bias, which causes the trajectory or path of the bowl to be curved relative to the bowling direction. The location of the centre of gravity varies within a set of bowls. One or preferably two grip rings are normally provided to help a bowler to locate his hand correctly and consistently on the ball and to provide some grip when launching and releasing the bowl. Grip is a particular problem with smooth bowls manufactured from plastics material. The grip rings may be in the form of patterns, indentations or grooves cut into the surface of the bowl with patterns in the grooves.

It is an object of the invention to provide a bowl with improved and customisable grip rings.

GENERAL DESCRIPTION OF THE INVENTION

According to the invention there is provided a bowl provided with at least one grip ring, preferably two, which grip ring is in the form of a first groove formed into the surface of the bowl and a second groove formed into the surface of the first groove; and a resiliently deformable or elastic band which fits into the second groove such the surface of the band is flush with or slightly proud of the surface of the first groove.

The first groove's cross-sectional profile may generally be concave to index or fit a person's finger to locate the bowl in the bowler's hands.

The second groove may be between 1 and 3 mm deep.

The second groove may generally be located in the apex of the first groove, such that the exposed surface of the band is flush with or slightly above the surface of the first groove. It is to be appreciated that a person who holds the bowl, ready to bowl will have his fingers indexed in the first grooves, making contact with the resiliently deformable or elastic band to provide enhanced grip or friction for launch, while still being countersunk to avoid contact between the band and any other bowls in play, when the bowl rolls into any of the other bowls in play.

The upper or exposed surface of the band may be patterned to enhance grip and aesthetics.

The resiliently deformable or elastic band may be selected from different colours for aesthetics, customisation or colour coded to indicate bowls in a set.

The resiliently deformable or elastic band may be manufactured to have a diameter which is less the diameter of the second groove such the band fits into the second groove under tension to provide a snug and non-slip fit.

The solid bowls may be manufactured from hardened plastics or polymeric material such as Melamine. It is to be appreciated that bowls are solid non-compressible balls meaning that they are manufactured from a solid material and they are not hollow or having spaces or gaps, consisting of the same substance throughout. Typically, the bowls may be cast and then machined on a lathe and/or milling machine. The first groove may preferably be machined by a lathe while the second groove may preferably be machined by a milling machine.

The resiliently deformable or elastic band may be manufactured from natural or preferably synthetic rubbers such as styrene-butadiene (SBR), chloroprene, polyisoprene, nitrile, polyisobutane, silicone or similar elastomers. In a preferred embodiment, the band may be manufactured from thermoplastic polyurethane (TPU).

The invention also extends to a resiliently deformable or elastic band for a bowl, in accordance with the invention.

The invention is to be applied to lawn bowls in sizes 000, 00, 0, 0.5, 0, 1, 1.5, 2, 2.5, 3, 3.5, 4, 4.5 and 5.

DETAILED DESCRIPTION OF THE INVENTION

The invention is now described by way of example with reference to the accompanying drawings.

Figure 2:
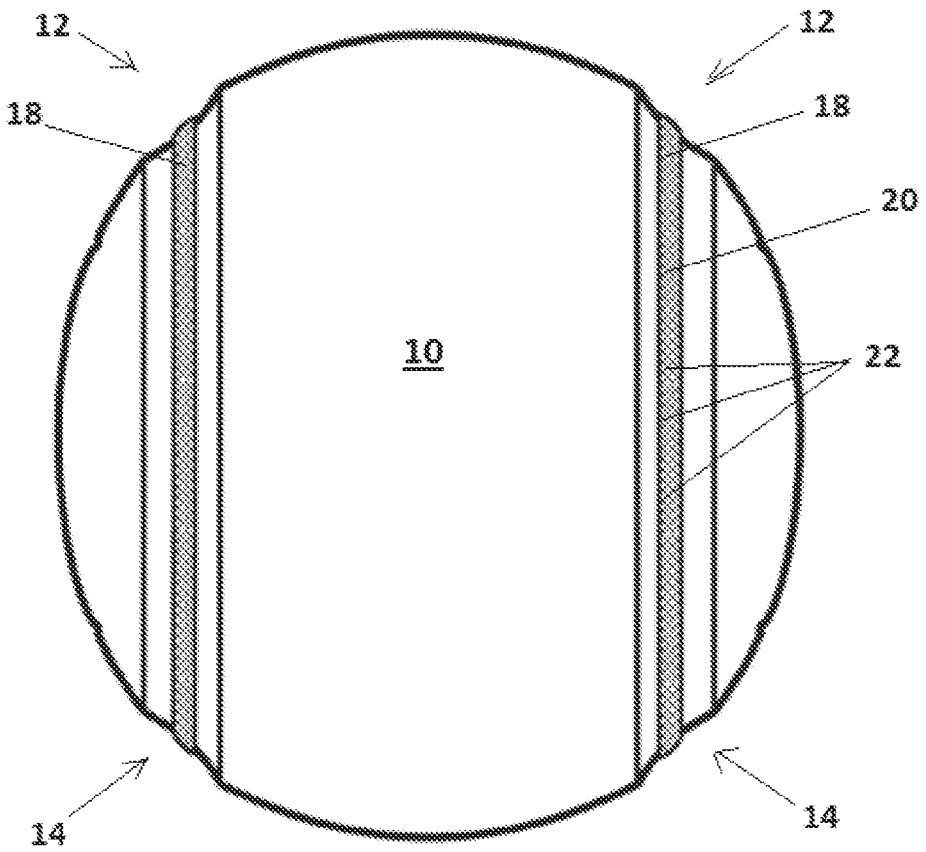

In the drawings:

FIG. 1 shows an end exploded view of a bowl, in accordance with the invention; and FIG. 2 shows an end view of an assembled bowl, in accordance with the invention.

Referring now to the drawings, the bowl, in accordance with the invention, is generally indicated by reference numeral 10.

The bowl 10 is provided with a pair of grip rings 12, which grip ring is in the form of a first groove 14, also known in the art as ZScoop™, formed into the surface of the bowl and a novel second groove 16 formed 3 mm into the surface of the first groove 14. The bowl 10 further comprises a resiliently deformable elastic band 18 moulded from TPU. The band 18 is partly countersunk and fits snugly and under tension into the second groove 16 such the upper surface 20 of the band is slightly proud of the surface of the first groove 14. The first groove's 14 cross-sectional profile is generally concave to index or fit a person's finger to locate the bowl 10 in the bowler's hands. The second groove 16 is located near the apex of the first groove 14. The upper or exposed surface 20 of the band 18 is patterned with small stubs 22 to enhance grip and aesthetics. The resiliently deformable or elastic band 18 is available in a selection of different colours for aesthetics, customisation or colour coded to indicate bowls in a set. In an example, grip rings 12 are substantially parallel to one another.

In this example, the bowl 10 is manufactured from MELAMINE. The bowls are cast then machined on a lathe and/or milling machine. The first groove is machined by a lathe while the second groove is machined by a milling machine.

It shall be understood that the example is provided for illustrating the invention further and to assist a person skilled in the art with understanding the invention and is not meant to be construed as unduly limiting the reasonable scope of the invention. It is to be understood that there are numerous variations and designs possible within the scope of the invention.

The invention claimed is:

1. A solid lawn bowl provided with at least one grip ring, which grip ring is in the form of a first groove machined into the surface of the bowl and a second groove machined into the surface of the first groove; and a resiliently deformable or elastic band dimensioned to fit snugly into the second groove such the surface of the band is flush with or slightly proud of the surface of the first groove, while still being countersunk relative to the surface of the bowl.

2. A bowl as claimed in claim 1, which includes two parallel opposed grip rings.

3. A bowl as claimed in claim 1, wherein the first groove's cross-sectional profile is concave.

4. A bowl as claimed in claim 1, wherein the second groove is generally located in the apex of the first groove.

5. A bowl as claimed in claim 1, wherein the surface of the band includes an exposed portion and the exposed surface of the band is patterned.

6. A bowl as claimed in claim 1, wherein the resiliently deformable or elastic band is selectable from different colours or colour coded to indicate bowls in a set.

7. A bowl as claimed in claim 1, wherein the resiliently deformable or elastic band is manufactured to have a diameter which is less the diameter of the second groove such the band fits into the second groove under tension to provide a snug and non-slip fit.

8. A bowl as claimed in claim 1, wherein the bowl is moulded and machined from hardened plastics or polymeric material.

9. A bowl as claimed in claim 1, wherein the resiliently deformable or elastic band is manufactured from thermoplastic polyurethane (TPU).

* * * * *